United States Patent [19]

Lowery et al.

[11] 4,122,975

[45] Oct. 31, 1978

[54] NAIL SEPARATOR APPARATUS

[76] Inventors: James V. Lowery, 1020 Dorothy St., Houston, Tex. 77008; Charles L. Lowery, 212 Taylor #2, Anchorage, Ak. 99504; Vernon L. Lowery, 6621 Stroud, Houston, Tex. 77074; Jimmy R. Lowery, 1040 Rutland, Houston, Tex. 77008

[21] Appl. No.: 799,377

[22] Filed: May 23, 1977

Related U.S. Application Data

[62] Division of Ser. No. 276,131, Jul. 28, 1972, Pat. No. 4,025,030.

[51] Int. Cl.[2] ..... B65H 9/00

[52] U.S. Cl. ..... 221/173; 198/389

[58] Field of Search ..... 221/156, 163, 167, 171; 227/119, 112; 10/162 A; 198/389, 390

[56] References Cited

U.S. PATENT DOCUMENTS

| | | | |
|---|---|---|---|
| 1,339,904 | 5/1920 | Monkhorst | 10/162 A |
| 3,365,048 | 1/1968 | Ehrlich et al. | 221/156 X |
| 3,647,129 | 3/1972 | Ehrlich | 227/112 |
| 3,815,730 | 6/1974 | Zwiep | 198/389 |

*Primary Examiner*—Allen N. Knowles

*Attorney, Agent, or Firm*—Donald Gunn

[57] ABSTRACT

The disclosed apparatus incorporates a generally rectangular framework for assembling a set of parallel rods defining adjacent grooves. The apparatus receives and stores a supply of nails in a container. The nails emerge from a storage container and drop onto a sorting device. The nails fall into grooves sized to receive the point but not the head. The head thus hangs, and the nail slides to the end of the groove. The apparatus simultaneously and consecutively drop nails, always in the same position.

16 Claims, 8 Drawing Figures

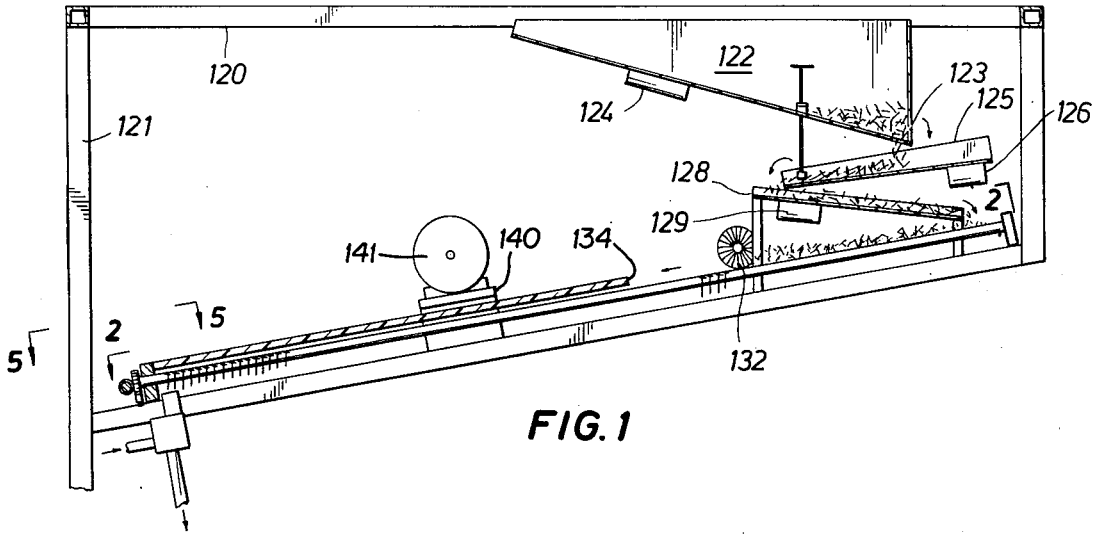
FIG. 1
FIG. 2
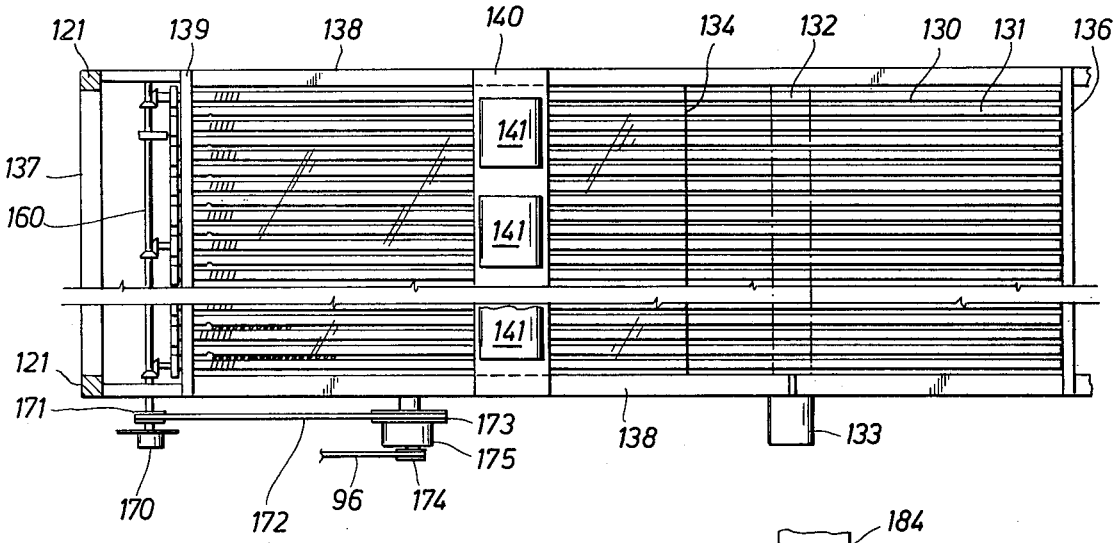
FIG. 3
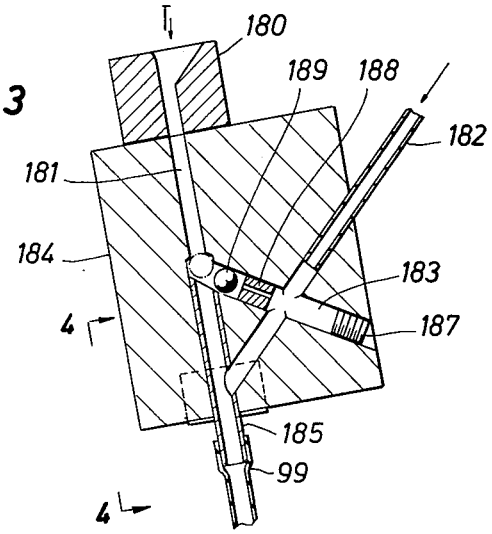
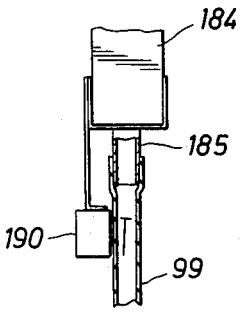
FIG. 4

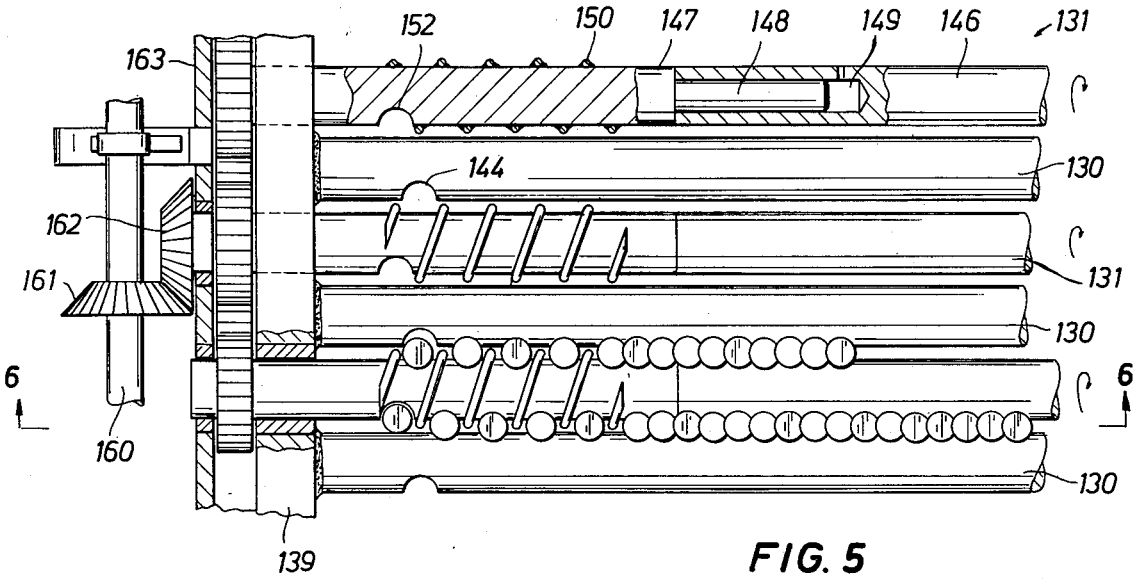
FIG. 5
FIG. 6
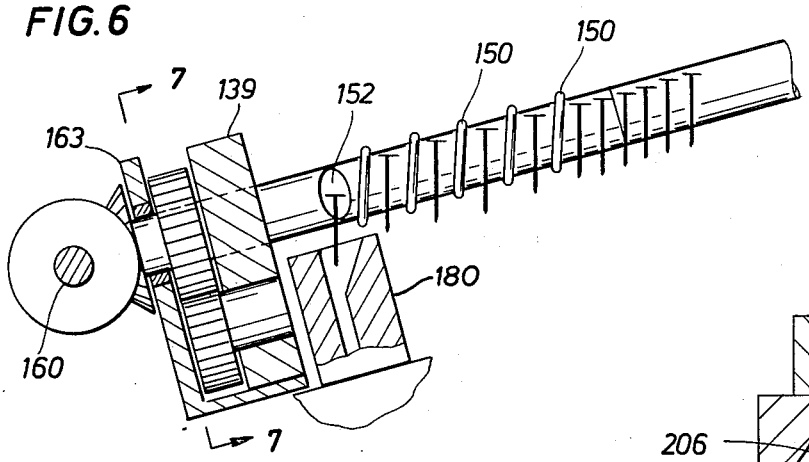
FIG. 3A
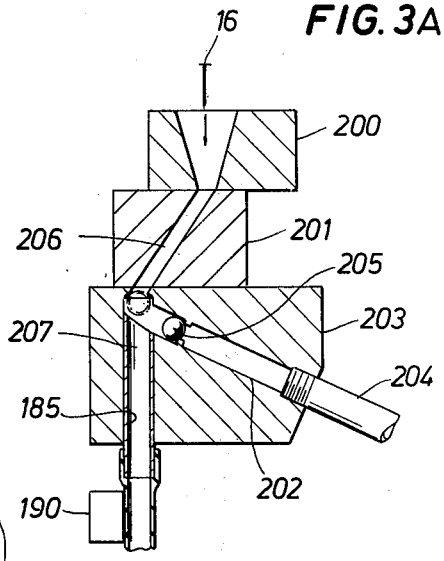
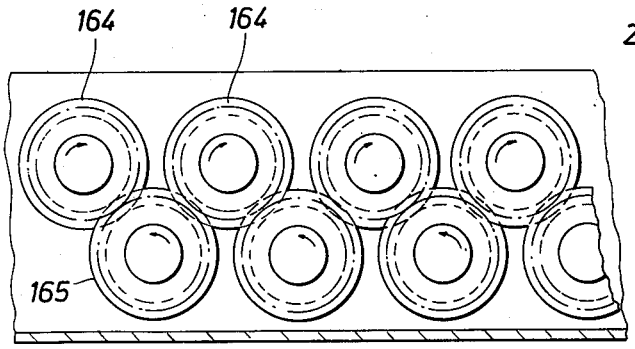
FIG. 7

NAIL SEPARATOR APPARATUS

RELATED APPLICATIONS

This is a divisional application out of Ser. No. 276, 131 filed July 28, 1972, now U.S. Pat. No. 4,025,030.

BACKGROUND OF THE INVENTION

The present invention is directed to a nail separating apparatus. The nails are received from the factory in a jumble, all dumped in a box or carton. This invention sorts them so they are aligned parallel to one another. When the alignment is achieved, they are dispensed one at a time at a controlled rate. The nails are able to be used by a nailer in predictable fashion.

SUMMARY OF THE INVENTION

The present invention is summarized as providing an apparatus for high speed large volume distribution of aligned nails. It includes a nail storage container which dumps nails onto a set of parallel rods. The rods are sloping and evenly spaced. The nails fall point first into slots but cannot fall through the slots. The nails wiggle and juggle down the slot or groove, and then they are dropped at the end through a notch sized to pass the head.

BRIEF DESCRIPTION OF THE DRAWINGS

FIG. 1 is an enlarged side view of a nail feeding mechanism;

FIG. 2 is a view taken along the line 2—2 of FIG. 1 showing the top of the nail separator mechanism including the mode of means whereby nails are provided to be used for each individual strip;

FIG. 3 is an enlarged sectional view of apparatus which receives nails from the nail separator and pneumatically forces them at high speed into a tubing for nailing purposes;

FIG. 3A shows an alternative form of apparatus to the structure of FIG. 3;

FIG. 4 is a sectional view taken along the line 4—4 of FIG. 3 showing the position of a magnet which holds the nails to achieve uniform timing in the apparatus;

FIG. 5 is an enlarged sectional view taken along the line 5—5 of FIG. 1 showing details of construction of the nail drop mechanism;

FIG. 6 is a sectional view taken along the line 6—6 of FIG. 5 showing an individual rotating rod having a screw formed on it for feeding individual nails to the apparatus illustrated in FIG. 3; and FIG. 7 is a sectional view taken along the line 7—7 of FIG. 6 showing a number of gears which cooperate together to provide drive to the nail separator permitting multiple operation of the apparatus to form multiple and parallel strips.

DESCRIPTION OF THE PREFERRED EMBODIMENT

Attention is first directed to FIG. 1 where a horizontal framework 120 is supported on vertical members 121 receives and supports a nail storage bin 122. The bin 122 is of a suitable size to receive a supply of nails which will last for a period of time. The nails are dumped into the bin 122. The bin 122 preferably has a specified width which can be varied. The bin 122 has a slot across its lower edge more or less located at 123. The bin 122 is filled with nails and a shaker 124 vibrates nails towards the slot 122. The slot 123 is positioned above a generally flat pan 125 and the nails fall in the pan 125 and tumble downhill. Again, the pan 125 has a vibrator 126. The vibrator 126 agitates the pan causing the nails to tumble and roll toward the lower end. The pan 125 is positioned above another pan 128. Thus, the pan 128 slopes back in the opposite direction toward a nail sorting mechanism as will be described. The pan 128 is likewise equipped with an additional shaker 129. As the nails travel over the described route, they are evenly distributed across the width of the equipment.

The sloping pans 125 and 128 cooperate together to spread the nails more or less evenly across the width of the apparatus. Suppose for sake of discussion, that the apparatus is 24 inches wide. The nails in the bin sometimes have occasion to bunch up so that too many nails are dumped at one portion of the width, while another portion is somewhat starved for nails. This may be the result of partial jamming at the slot 123. Through the use of the rather long sloping surfaces and associated vibrators, the nails are spread more evenly. In any case, they slide along the pan 125 and off its lower end and then along the pan 128 and off its lower end. At this juncture, the nails are on the nail separator which will be described utilizing FIG. 2 of the drawings.

The nail separator shown in FIG. 2 incorporates a number of parallel rods indicated by the numerals 130 and 131. They are parallel to and spaced from one another by a distance less than the width of the head of the tacks. The slot between adjacent bars is sufficient for the point to drop through, but not the head. As viewed in FIG. 2, the nails fall on the several parallel round rods and are jiggled downwardly by vibrators as will be described.

A brush 132 and the motor which rotates the brush is indicated by the numeral 133. An upstanding bracket supports the motor 133. The brush causes the nails to point downwardly.

A transparent elastomeric cover 134 covers the lower portion of the nail separator. It is placed over the round bars 130 and 131 to keep the nails from jiggling upwardly and jumping out of the slots.

The nail separator is fabricated on a rectangular framework including end pieces 136 and 137 and parallel side pieces 138. A transverse member 139 is near the end piece 137. A space is defined between the frame members 137 and 139 for receiving a power transmission network as will be described hereinafter. A relatively wide support bracket 140 spans the width of the equipment and is joined to the side rails 138. It supports a plurality of vibrators 141 which shake the entirety of the nail separator. This helps jiggle the nails downhill into the slots between the adjacent bars.

For a better understanding of the nail separator top, attention is next directed to FIG. 5 of the drawings. In FIG. 5, an enlarged view shows the lower ends of several of the rods 130 and 131. The rods 130 are fixed in position by the transverse frame member 139. The rods 130 are notched at 144. The rods 131 are adapted to rotate. The upper rod in FIG. 5 should be considered in detail. The rod 131 is comprised of two portions, the upper portion being indicated by the numeral 146 and the lower portion being indicated by the numeral 147. The portion 146 does not rotate, but the portion 147 does rotate. The interconnection between the rod portions 146 and 147 is achieved by positioning a stem 148 in a central drilled opening 149. The opening 149, and the axial extension 148, thus center the rod 147 in the opening 149. A small hole to the exterior is incorporated in communication with the counterbored opening 149 to permit the insertion of a lubricant such as graphite. Thus, the rod 146 does not rotate while the portion 147 does.

At this juncture, it should be observed that a narrow slot is defined between each pair of rods. The slot is large enough to receive the shank of the tacks, but not large enough to permit the head to pass through. The nails slide down until they reach the portion 147. The rotating portion 147 carries on its exterior a helix 150. The helix 150 rotates so that the forwardmost point or edge forces its way between the heads of two adjacent nails as shown in FIG. 5. The spacing or pitch of the helix 150 is such that individual nails are captured between turns of the helix. This is shown better in FIG. 5. The helix then carries the nails from the beginning or upper end of the helix towards the lower end. THe rod 147 is notched at 152. The helix progresses the nails downwardly between the adjacent rods until each nail drops through the notch 144 or 152. It will be noted that a tangential hole or dropthrough notch is formed in each rod while each helix serves double duty for itself and the two adjacent rods. As shown in FIG. 6, a nail is just dropping through the opening. The tangential hole 152 is sufficiently large for the head of the nail to drop through. It drops through another apparatus as will be described.

Attention is next directed to FIG. 5 of the drawings where the numeral 160 identifies the drive shaft. A beveled gear 161 is carried on it. The gear 161 engages an additional beveled gear 162. The beveled gear 162 is common to the lower portion of one of the rotating shafts 131. The lower portion passes through the transverse frame member 139 and is likewise supported by a back-up plate 163. The plate 163 is parallel to the member 139. A plurality of gears is located between the two plates. The gears are better shown in the sectional view of FIG. 7. The numeral 164 identifies a first gear. It is engaged with a second gear 165 which rotates in the opposite direction. An additional gear 164 rotates in the same direction. The gear train extends all the way across the nail separator with alternating gears and idlers. All the gears 164 rotate in the same direction and at the same speed. All of the idler gears 165 rotate in the opposite direction and merely serve as a means of interconnection.

The gear train is received between the frame member 139 and the plate 163. The plate 163 is preferably L-shaped as shown in FIG. 6 and is joined to the frame member 139 at its bottom edge. The frame member 139 is drilled at the appropriate locations to receive the supporting shafts for the various gears.

A suitable power source drives the separator by means of positive connection of a chain or belt drive mechanism connected with the nail separator apparatus as shown in FIG. 2.

The drop of the nails should next be considered. As shown in FIG. 6, as the nails begin to fall from the tangential hole 152, they fall into a funnel-shaped block 180. Such a funnel-shaped block is provided at each point where a nail is dropped, and hence is duplicated across the width of the nail separator. Attention is returned to FIG. 3 where the funnel-shaped block 180 is illustrated. It communicates by means of a generally downwardly passage 181 with a valve body. The numeral 182 identifies a line for air applied under pressure. An intersecting passage 183 is found in the body of the block 184. The passage 180 is enlarged at its lower end to receive a tubular member 185. The member 185 is connected with a flexible conduit or tubing member 99 which delivers the nail to the respective nail guides. The intersecting passage 183 is plugged at 187. An orifice plug 188 has a slight bleed hole in it for introducing air behind a ball check valve element 189. The ball is sized so that it rolls upwardly on the introduction of air pressure into the passage 181. The ball thus blocks the passage 181 and prevents air from going up the passage and attempt to blow a nail out of the funnel-shaped member 180, and air wastage is reduced. The lateral passage 182 intersects the main passage member 185 to direct the blast of air downwardly and into the tube 99. This blows the nail with sufficient velocity to cause it to pass all the way through the nail guide and to embed in the strip.

Relative timing between adjacent nail drop mechanisms is achieved through the use of a magnet 190 shown in FIG. 4. The magnet holds the nail inasmuch as the nails are practically always formed of ferromagnetic materials. The nails are all held up for simultaneous nailing. The nails may drop out of the separator somewhat unevenly, but they are caught and held temporarily by the magnet. The valve mechanism shown in FIG. 3 associated with each nail drop mechanism is connected to a common manifold, and hence, delivery of air to the common manifold operates all of the nail drop mechanisms simultaneously to force the nails downwardly simultaneously. The nails travel at a high velocity, through the tubing members 99 point first. Since they are impelled by the same or common blast of air, they all depart substantially simultaneously and are delivered simultaneously.

An alternative form of nail drop mechanism is shown in FIG. 3A. The numeral 200 identifies the funnel-shaped member which receives the nail 16. A second member 201 narrows the funnel and erects the nail at an angle. The passage in the member 201 is at an acute angle with respect to the passage 202 and an additional member 203. The numeral 204 identifies an air inlet line which is threaded to the block 203 and which is adapted to deliver a substantial quantity of air through the passage 202. The numeral 205 identifies a ball-shaped check valve element. It has a lower position determined by an enlargement in the passage 202. Its upper position is determined at the point of intersection of passages 206 and 207. The passage 206 is large enough to receive the nail, but is smaller than the ball. The ball rolls upwardly under the blast of air and plugs the passage 206. This directs the entire blast of air downwardly for the duration of the blast of air. When the air blast terminates, the ball falls back to the position indicated in FIG. 3A. The passage 207 is of sufficient diameter to receive the member 185 therein, the magnet 190 being furnished in the same manner as that illustrated in FIG. 3.

The nail separator can have only two parallel bars or rods (defining only a single slot) and thereby deliver a single flow of nails timed at an even or steady flow determined by the rate of rotation of the rods. The device can supply two streams or more. The width and hence the number of rods is variable, and can be increased without limit. The rate at which nails are supplied is dependent on the rotational rate of the separator. The disclosed embodiment is the preferred form, but the scope hereof is determined by the claims which follow.

We claim:

1. A nail separator comprising:

(a) container of nails adapted to supply a plurality of nails arranged in a random manner with respect to one another;

(b) at least a pair of parallel and spaced rods in proximity of said source and arranged to receive thereon a plurality of nails, said rods being spaced apart by a distance greater than the diameter of the shaft of the nails but less than the width of the heads thereon to define a slot;

(c) a worm arranged around at least one of said rods and having a pitch sized to receive the shaft of one of the nails between adjacent turns on said worm;

(d) means for relatively advancing said worm relatively toward a plurality of nails in the slot so that said worm engages one of the nails between adjacent turns; and (e) notch means adjacent to said worm and formed in one of said rods, said notch means being sized to drop the head of a nail through said notch means.

2. The invention of claim 1 further including means joining said worm to one of said rods and wherein said worm extends into the slot therebetween and wherein said adjacent rods are generally round.

3. The invention of claim 1 including means connected to alternate rods for rotating them.

4. The invention of claim 1 wherein said rods are arranged in a common plane and slope from a point below said source of nails to a lower point with the slope being sufficient to cause nails in the slots between adjacent rods to move down slope, and including means for rotating at least some of said rods.

5. The invention of claim 4 wherein said source spills nails on said rods.

6. The invention of claim 1 wherein alternate ones of said spaced rods are rotated in a common direction and the remaining ones of said rods are not rotated; and including notch means either in said ones or in the remaining ones of said rods, said notch means having a common orientation with respect to the axis of said rods.

7. The apparatus of claim 1 including a supportive framework with first and second support members supporting said spaced rods.

8. The apparatus of claim 7 including first and second rod bearings for a rotating rod.

9. The apparatus of claim 7 including a drive gear train connected to a rotating rod to rotate it.

10. The apparatus of claim 1 including a planar surface located immediately above at least a part of said spaced rods and having a spacing therefrom which enables the heads of the nails to be supported by said spaced rods but which surface is sufficiently close to prevent said nails from jiggling, jumping, or otherwise wiggling upwardly and out from between said spaced rods.

11. The apparatus of claim 1 including vibrator means for agitating said spaced rods to shake and jiggle the nails.

12. The apparatus of claim 1 wherein said spaced rods are inclined from the horizontal and collectively define a plane which slopes downhill so that the nails are gravity fed along said spaced rods toward said worm, and including a brush which brushes the nails uphill along said rods to thereby scatter them in a random fashion.

13. The apparatus of claim 1 including:

(a) a planar surface spaced immediately above said spaced rods and having a proximity thereto which enables the heads of the nails to be supported by said spaced rods but which surface is sufficiently close to prevent said nails from jiggling, jumping, or otherwise siggling out from between said spaced rods;

(b) vibrator means for agitating said spaced rods to shake and jiggle the nails; and (c) wherein said spaced rods are inclined from the horizontal and collectively define a plane which slopes downhill so that the nails are gravity fed along said spaced rods toward said worm, and including a brush which brushes the nails uphill along said rods to thereby scatter them in a random fashion.

14. The apparatus of claim 1 including a funnel below said notch means for receiving the nail therein which funnel connects to a downwardly directed opening; a lateral passage connected to said downwardly directed passage, said lateral passage being adapted to deliver air under pressure for blowing the nail to an apparatus which requires the nail to be delivered point first wherein the two passages intersect at approximately a right angle.

15. The apparatus of claim 1 where said rods are round.

16. The apparatus of claim 1 including means for fixedly attaching a cover at a spaced distance above said rods, the distance being determined such that the nails are prevented from riding above one another and jiggling out of the space between adjacent spaced rods and wherein a support means fixes said rods in lateral spaced relationship to one another.

* * * * *